US007016623B2

(12) United States Patent
Isobe

(10) Patent No.: US 7,016,623 B2
(45) Date of Patent: Mar. 21, 2006

(54) IMAGE FORMING APPARATUS WITH POWER CONTROL TO SHEET PROCESSING UNIT

(75) Inventor: Yoshinori Isobe, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 112 days.

(21) Appl. No.: 10/704,635

(22) Filed: Nov. 12, 2003

(65) Prior Publication Data

US 2004/0096235 A1 May 20, 2004

(30) Foreign Application Priority Data

Nov. 15, 2002 (JP) ..... 2002-332337

(51) Int. Cl.
*G03G 15/00* (2006.01)

(52) U.S. Cl. ..... 399/88; 399/407

(58) Field of Classification Search ..... 399/75, 399/88, 397, 407, 408, 409, 410
See application file for complete search history.

(56) References Cited

U.S. PATENT DOCUMENTS 5,351,112 A 9/1994 Naito et al. ..... 355/233
5,579,083 A 11/1996 Naito et al. ..... 355/50
5,819,151 A 10/1998 Naito et al. ..... 399/367
6,072,585 A * 6/2000 Dutton et al. ..... 358/1.12
6,371,471 B1 4/2002 Fukazu et al. ..... 270/58.09
6,398,214 B1 6/2002 Moteki et al. ..... 271/220
6,405,001 B1 * 6/2002 Sumiyoshi ..... 399/88
6,408,148 B1 * 6/2002 Yamamoto ..... 399/88
6,471,429 B1 10/2002 Isobe et al. ..... 400/582
6,549,734 B1 * 4/2003 Yamada et al. ..... 399/81

FOREIGN PATENT DOCUMENTS

JP 9-188037 * 7/1997

* cited by examiner

*Primary Examiner*—Hoan Tran
(74) *Attorney, Agent, or Firm*—Fitzpatrick, Cella, Harper & Scinto

(57) ABSTRACT

An image forming apparatus has an image forming device, a first discharge tray for receiving a sheet on which an image was formed, a conveyer for selectively transporting the sheet on which the image was formed by the image forming device to one of a first discharge tray and a sheet processing device, and a controller for controlling a power source so as not to supply electric power to the sheet processing device and the conveyer to transport the sheet to the first discharge tray when discharging the sheet to the first discharge tray, and controlling the power source to supply power to the sheet processing device and the conveyer to transport the sheet to the sheet processing device when discharging the sheet to a second discharge tray provided on the sheet processing device.

8 Claims, 3 Drawing Sheets

IMAGE FORMING APPARATUS WITH POWER CONTROL TO SHEET PROCESSING UNIT

BACKGROUND OF THE INVENTION

1. Field of the Invention

The present invention relates to an image forming apparatus provided with a sheet processing device for processing sheets, such as recording sheets, discharged from the image forming apparatus, such as a copying machine, a printer, and a facsimile, especially from a main body of the apparatus in sequence, and selectively carrying out processing, such as punching or stapling, on the sheets.

2. Description of the Related Art

Hitherto, in an image forming apparatus for forming an image on the surfaces of sheets of, for example, a copying machine, there is provided a sheet processing device (finisher) for aligning the discharged sheets in sequence into a plurality of sets, and for carrying out processing such as punching and stapling on the sheets.

The sheet processing device is advantageous because the handling property of the sheets is significantly improved, and thus it has become widely used in recent years.

However, the image forming apparatus having an integral sheet processing device as described above has a problem in that even when the user wants to print on a single sheet, or wants to obtain sheets which do not need sheet processing such as stapling, electric power for initializing each sheet processing unit or for transporting the sheets to a sheet discharge tray located downstream of the sheet processing unit is inevitably consumed even when the sheet processing operation is not carried out.

According to U.S. Pat. No. 6,371,471, there is shown a technology in which power is supplied to an insert sheet feeder only when the user sets the apparatus to deliver the inserted sheet on a control panel. However, the system disclosed in U.S. Pat. No. 6,371,471 is constructed in such a manner that a finisher controller turns ON/OFF the power to a plurality of sheet processing units including the insert sheet feeder, but not the power to the finisher, that is, the sheet processing device itself. Therefore, even when the sheet is discharged onto the discharge tray provided on the image forming apparatus, in other words, even when the sheet is not discharged to the sheet processing device, the system supplies electric power to the sheet processing device itself and carries out an initializing operation for moving movable portions in the sheet processing device to their home positions when power supply is started. Consequently, there remain problems of standby power requirement of the sheet processing device and of operating noise generated when the sheet processing device performs the initializing operation in the case where the sheet is not discharged to the sheet processing device.

SUMMARY OF THE INVENTION

In view of such problems described above, it is an object of the present invention to provide an image forming apparatus able to discharge sheets without consuming electric power in the sheet processing unit when discharging the sheets which do not need sheet processing, and thus reduce total consumption of electric power.

According to the invention, there is provided an image forming apparatus to which a sheet processing device can be connected including:

an image forming device for forming an image on a sheet;

a first discharge tray for receiving the sheet on which the image is formed by the image forming device:

a conveyer for selectively transporting the sheet on which the image is formed by the image forming device to one of the first discharge tray and the sheet processing device; and a controller for controlling a power source so as not to supply electric power to the sheet processing device and to supply electric power to the conveyer to transport the sheet to the first discharge tray when discharging the sheet to the first discharge tray, and controlling the power source to supply power to the sheet processing device and to the conveyer to transport the sheet to the sheet processing device when discharging the sheet to a second discharge tray provided on the sheet processing device.

The image forming apparatus, preferably, further includes an input unit for entering an instruction for starting image formation, and the controller controls the power source so as not to supply the electric power to the sheet processing device until an image formation start instruction is when discharging the sheet to the second discharge tray provided on the sheet processing device and to start supplying the electric power to the sheet processing device after the image formation start instruction is entered via the input unit.

The controller preferably stops supply of electric power to the sheet processing device after the image forming operation by the image forming device is terminated.

The sheet processing device preferably performs any one of functions of punching, stacking, aligning, and stapling of the sheets.

The image forming apparatus according to the invention preferably further includes an operating unit for selecting a destination of the sheet, and the controller controls power supply and sheet transportation depending on the selection made via the operating unit.

The image forming apparatus preferably further includes an operating unit for setting the sheet processing details for the sheet, and the controller controls the power source so as not to supply electric power to the sheet processing device and to supply electric power to the conveyer to transport the sheet to the first discharge tray when the sheet processing operation for the sheet is not selected and controls the power source to supply the electric power to the sheet processing device and the conveyer to transport the sheet to the sheet processing device when the sheet processing operation is selected via the operating unit.

According to another aspect of the invention, there is provided an image forming apparatus to which a sheet processing device can be connected, including:

an image forming device for forming an image on a sheet;

a first discharge tray for receiving the sheet on which the image is formed by the image forming device;

a conveyer for selectively transporting the sheet on which the image is formed by the image forming device to one of the first discharge tray and the sheet processing device; and a first controller and a second controller, the first controller for controlling a power source so as not to supply electric power to the sheet processing device and a second controller for controlling the sheet processing device and the conveyer to transport the sheet to the first discharge tray when discharging the sheet to the first discharge tray, and controlling the power source to supply the electric power to the sheet processing device and the second controller and the conveyer to transport the sheet to the sheet processing device when discharging the sheet to a second discharge tray provided on the sheet processing device.

The second controller preferably carries out an initializing operation for a predetermined sheet processing unit in the sheet processing device after the power supply is started by the first controller.

The initializing operation for the sheet processing unit is preferably to move a movable unit of the sheet processing unit to their home positions.

Further objects, features and advantages of the present invention will become apparent from the following description of the preferred embodiments (with reference to the attached drawings).

DESCRIPTION OF THE PREFERRED EMBODIMENTS

Figure 1:
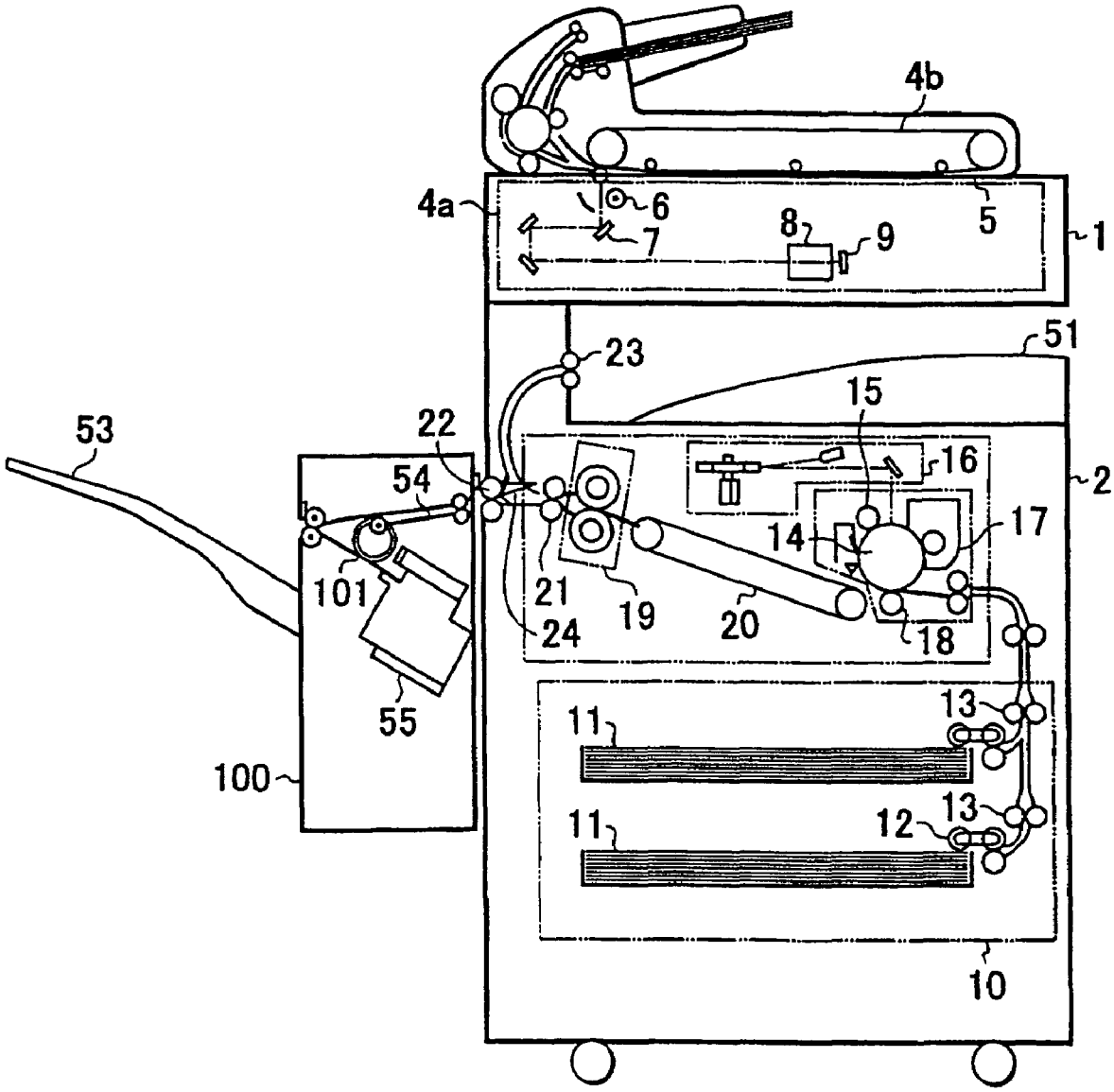
FIG. 1 is a cross-sectional view showing a construction of an image forming apparatus according to an embodiment of the invention.

Referring now to the drawings, an image forming apparatus having a sheet processing device according to an embodiment of the invention will be described.

FIG. 1 is a cross-sectional view showing the general construction of an image forming apparatus according to the invention. Components of a main body of the image forming apparatus and of the sheet processing device will be described respectively.

[Entire Image Forming Apparatus]

The image forming apparatus includes an image reading device 1 for reading an image drawn on a sheet, and an image forming device 2 for forming the image read by the image reading device 1 on a recording sheet, and the image reading device 1 is arranged above the image forming device 2. Provided on the left side of the image forming device 2 in FIG. 1 is a sheet processing device 100 for carrying out at least one of punching, stacking, aligning, and stapling of the sheets with images formed thereon.

(Image Reading Device)

The image reading device 1 includes an ADF (Automatic Document Feeder) 4*b* mounted on a scanning optical system 4*a* for optically reading an original, and reads the original fed from the ADF 4*b* to a platen glass 5, or placed manually on the platen glass 5 by the user without using the ADF 4*b*, by carrying out exposure scanning by a scanning optical system 4*a*.

In other words, the image reading device 1 irradiates a light beam on the original placed on the platen glass 5 while controlling a light source 6, collecting reflected light beams by a mirror 7 and a lens 8 onto a photoelectric conversion element 9, converts the collected light beams into electrical digital signals, and transmits them to other units. When the digital signals are transmitted to the image forming device 2, the unit functions as copying machine, and when they are transmitted to an image forming device of a separate remote machine, it functions as facsimile.

The image reading device 1 is not necessarily required to include the ADF 4*b*. In other words, the image reading device 1 may have only a sheet holding member for holding the original placed on the platen glass 5 of the scanning optical system 4*a*.

(Image Forming Device)

The image forming device 2 forms a toner image electrophotographically on the sheet transported from a sheet cassette 11 installed in a sheet feeding unit 10, which is disposed in the lower portion the image forming device 2. Transport is via a feeding roller 12 and transport rollers 13. In the latent image is formed on photoreceptor drum 14 by charging the surface of the photoreceptor drum 14 uniformly with a charging roller 15, and exposing photoreceptor drum 14 to a light beam emitted from a laser scanner 16 based on image information supplied from the above-described image reading device 1 or on information from a personal computer. Then the latent image is transformed into a visual image by being developed by a developer 17 using toner, and the toner image is transferred to the sheet by bias application to a transfer roller 18.

The sheet on which the toner image is transferred as described above is transported to a fixing unit 19 by a transport belt 20 and applied with heat and pressure so that the toner image is fixed on the sheet. Subsequently, the sheet is guided by a flapper 24 driven by a driving unit such as a solenoid, not shown, and discharged to the sheet processing device 100 or to a normal tray 51.

[Sheet Processing Device]

The sheet processing device 100 includes an aligning unit and a stapling unit in this embodiment. As shown in FIG. 1, sheet processing is carried out on the sheet and the sheet is discharged to an elevating tray 53.

When the operator indicates via an operating unit 61 (See FIG. 2) that sheet processing such as stapling is required, the sheet discharged from discharge roller 22 of the image forming device 2 passes through a sheet path 54, and is transported into a sheet processing unit 101, where predetermined processing such as stapling with a stapling unit 55 is carried out, and then is discharged and stacked onto the elevating tray 53. The elevating tray 53 for sheet processing may be moved independently upward and downward by a motor, not shown.

Figure 2:
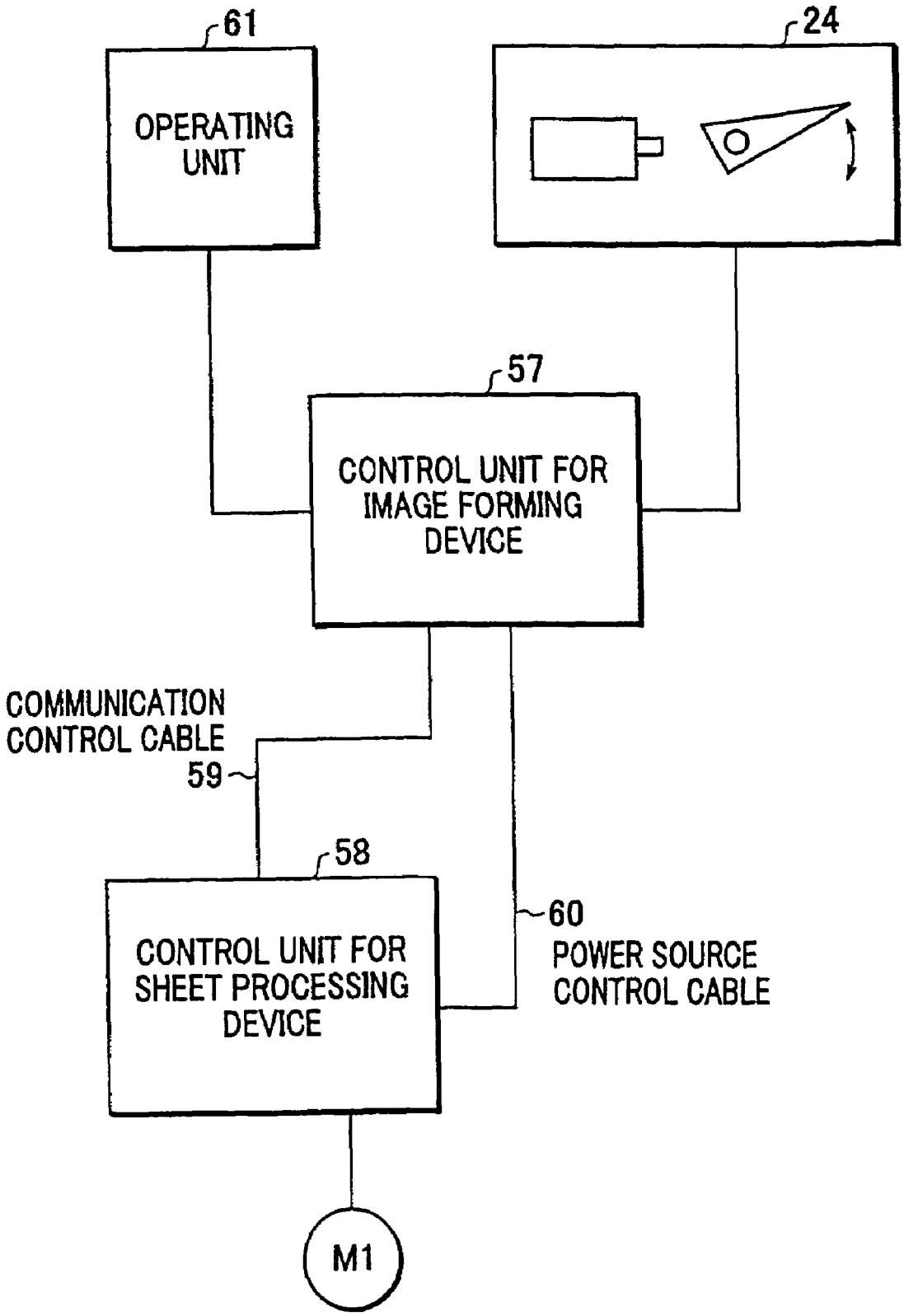
FIG. 2 is a block diagram showing a construction of a control system of the embodiment.

FIG. 2 is a block diagram showing the construction of a control system for an energy-saving operation according to the present embodiment. In FIG. 2, reference numeral 24 designates the flapper for switching the destination of the sheet on which the image is fixed at the image forming device 2 between discharge roller 22 and discharge roller 23, reference numeral 57 designates a control unit for controlling the image forming device 2, which also controls the flapper 24. Reference numeral 58 designates a control unit for controlling the sheet processing device 100, and is connected to the image forming device control unit 57 at least via a communication control cable 59 and a power source control cable 60.

In this embodiment, the discharge rollers 22, 23 for discharging the image-formed sheet are provided, and the flapper 24 switches between sheet discharging paths to select a path to go to one of the discharge rollers 22 and 23. The sheet processing device 100 can be connected to the image forming apparatus having discharge roller 22. The control unit 57 for image forming device controls power supply to the sheet processing device 100 depending on the sheet processing mode.

When the normal tray 51 is selected as a destination of the image-formed sheet, the flapper 24 is moved downward, and the control unit 57 for image forming device instructs control unit 58 to stop or reduce power supply to the for sheet processing device. When no instruction indicating that sheet processing is to be carried out on the image-formed sheets is made, the flapper 24 is moved downward, the control unit 57 instructs control unit 58 to stop or reduce power supply to the sheet processing device 100.

Normal tray 51 serving as a sheet stacking unit is disposed between the image reading device 1 and the image forming device 2 arranged at different levels. Discharge roller 22 is disposed at a position where the sheet passing through roller 22 will be discharged onto the elevating tray 53, so that the sheets are stacked after having sheet processing.

Figure 3:
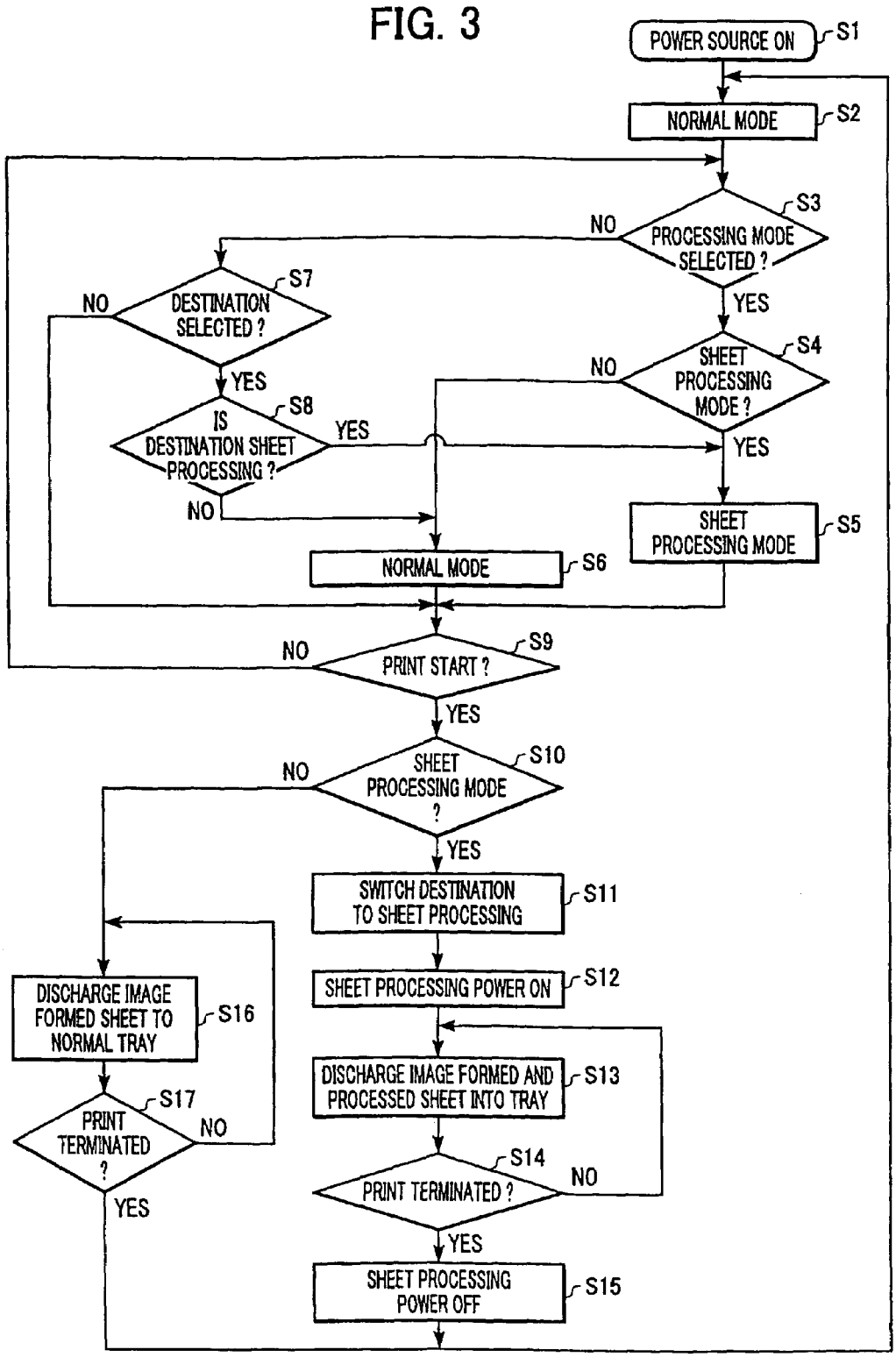
FIG. 3 is a flowchart showing a control operation of the embodiment.

FIG. 3 is a flowchart showing an energy-saving control operation of the present embodiment. The process shown in this flowchart is implemented according to a program which is stored in a control CPU in the control unit 57 for the image forming device provided in the image forming apparatus in advance.

When the power source for the image forming device 2 is turned ON (S1), the control unit 57 for image forming device carries out an initializing operation of the image forming device 2, and the discharge mode is set to the normal mode (S2). Then, the operating unit 61 determines whether or not the sheet processing mode is selected (S3). If the sheet processing mode is not selected, the operating unit 61 in turn determines whether or not the destination is selected (S7). When the destination is not selected, the system is kept in a waiting state for print start (S9).

When it is determined that the sheet processing mode is selected in the step of determining whether or not the sheet processing mode is selected (S3), the selected mode is determined (S4). When it is determined that the sheet processing mode has been selected, the discharge mode is switched to the sheet processing mode (S5), and when it is determined that the sheet processing mode is not selected, the discharge mode is kept in the normal mode (S6). In the normal mode, no sheet processing takes place.

Then, when it is determined that the destination is selected in the step of determining whether or not the destination is selected (S7), the selected mode is determined (S8). When it is determined that the selected destination is the sheet processing device, the discharge mode is switched to the sheet processing mode (S5), and when it is determined that the selected destination is not the sheet processing device, the discharge mode is kept in normal mode (S6).

After the steps (S5) or (S6) are completed, the system is brought into a print start waiting mode (S9). In this print start waiting mode (S9), various settings are acceptable until printing operation is started, and the system waits for selection of the discharge mode.

Subsequently, when a start key of the operating unit 61 is pressed, whether or not the sheet processing mode was selected in Step S5 is determined (S10). When the destination mode is determined to be the sheet processing mode, the flapper 24 is switched to a position in which the image-formed sheet can be discharged via the discharge roller 22 to the sheet processing device 100 (S11) by the control unit 57 for image forming device. Subsequently, power for the sheet processing device is turned ON (S12) via the control to supply electric power to the sheet processing device 100 via the power source control cable 60.

The power supply described above may be such that the electric power is directly provided from the power source or a power source mounted on the sheet processing device 100 by remote signals. Alternatively, it is also possible to control part of the electric power, for example, by switching the CPU to a sleep mode.

When the power to the sheet processing device is turned ON by the control unit 57 for image forming device via the power source control cable 60, the control unit 58 for sheet processing device performs the initializing operation that moves the movable units such as the sheet aligning unit in the sheet processing device to their home positions.

Subsequently, the sheet processing device 100 stacks the image-formed sheets on the elevating tray 53 (S13). These procedures are repeated until the printing operation is terminated (S14). When the printing operation is terminated, the control unit 57 for image forming device turns the power to the sheet processing device OFF (S15), and brings the system to a state where it waits for selection of discharge mode and for print start (S9).

On the other hand, when the sheet processing mode is not selected (S10), the flapper 24 is switched to a position by the control unit 57 for image forming device to discharge the image-formed sheets to the normal tray 51 via the discharge roller 23 (S11). Then, the image forming device 2 stacks the image-formed sheets on the normal tray 51 (S16). These procedures are repeated until the printing operation is terminated (S17). When the printing operation is terminated, the system is brought into the waiting state to await for selection of discharge mode and for print start (S9). As is clear when comparing the Steps S16 to S17 and the Steps S11 to S15, when the print start key is pressed in a state in which the sheet processing mode is not selected in Step S5 and is kept in the normal mode in Step S6, the procedure goes to Step S16, and the image forming operation and the discharging operation of the sheet onto the normal tray 51 are performed without turning ON the power to the sheet processing device 100 via the control unit 58 of the sheet processing device.

As described above, according to the embodiment, the image forming apparatus including the sheet processing device for carrying out processing on image-formed sheets such as punching and stapling is constructed to have the discharging path in which no sheet processing is carried out separately from a path leading to the sheet processing device so that power control of the sheet processing device can be performed from the main body of the image forming apparatus. Therefore, when discharging sheets which do not need sheet processing, the sheets can be discharged without consuming electric power by itself, and thus total consumption of electric power is reduced.

Although the sheet processing units described above are an aligning unit and a stapling unit, the present invention is not limited thereto, and may be applied to other sheet processing units such as a punching unit for forming holes on discharged sheets or a folding unit for folding the sheets.

In addition, while in the embodiment described above, the sheet processing mode is selected from the operating unit 61, the mode may be selected via data communication from, for example, a personal computer.

As described thus far, the invention provides for an image forming apparatus having a sheet processing device for carrying out sheet processing such as punching or stapling, which is able to discharge sheets without consuming electric power by the sheet processing unit when discharging sheets which do not need sheet processing, and thus reduce total consumption of electric power.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims.

What is claimed is:

1. An image forming apparatus adapted for connection to a sheet processing device comprising:

an image forming device for forming an image on a sheet;

a first discharge tray for receiving the sheet on which the image is formed by the image forming device;

a conveyer for selectively transporting the sheet on which the image is formed by the image forming device to one of the first discharge tray and the sheet processing device; and a controller for controlling a power source so as not to supply electric power to the sheet processing device and to supply electric power to the conveyer to transport the sheet to the first discharge tray when discharging the sheet to the first discharge tray, and controlling the power source to supply power to the sheet processing device and to the conveyer to transport the sheet to the sheet processing device when discharging the sheet to a second discharge tray provided on the sheet processing devices, wherein the controller stops a supply of electric power to the sheet processing device after an image forming operation by the image forming device is terminated.

2. An image forming apparatus according to claim 1, further comprising:

an input unit for entering an image formation start instruction for starting image formation;

wherein the controller controls the power source so as not to supply the electric power to the sheet processing device until the image formation start instruction is entered when discharging the sheet to the second discharge tray provided on the sheet processing device and to start supplying the electric power to the sheet processing device after the image formation start instruction is entered.

3. An image forming apparatus according to claim 1, wherein the sheet processing device comprises any one of a punching unit, a stacking unit, an aligning unit, and a stapling unit.

4. An image forming apparatus according to claim 1, further comprising:

an operating unit for selecting a sheet destination, wherein the controller controls power supply and sheet transportation in accordance with a selection made via an operating unit for setting sheet processing details.

5. An image forming apparatus according to claim 1, further comprising:

an operating unit for setting sheet processing details for the sheet, wherein the controller controls the power source so as not to supply electric power to the sheet processing device and to supply electric power to the conveyer to transport the sheet to the first discharge tray when a sheet processing operation for the sheet has not been selected on the operating unit and controls the power source to supply electric power to the sheet processing device and to the conveyer to transport the sheet to the sheet processing device when a sheet processing operation for the sheet has been selected on the operating unit.

6. An image forming apparatus adapted for connection to a sheet processing device comprising:

an image forming device for forming an image on a sheet;

a first discharge tray for receiving the sheet on which the image is formed by the image forming device;

a conveyer for selectively transporting the sheet on which the image is formed by the image forming device to one of the first discharge tray and the sheet processing device; and a first controller and a second controller, said first controller for controlling a power source so as not to supply electric power to the sheet processing device and the second controller for controlling the sheet processing device and the conveyer to transport the sheet to the first discharge tray when discharging the sheet to the first discharge tray, and controlling the power source to supply the electric power to the sheet processing device and the second controller and the conveyer to transport the sheet to the sheet processing device when discharging the sheet to a second discharge tray provided on the sheet processing device, wherein the first controller stops a supply of electric power to the sheet processing device after an image forming operation by the image forming device is terminated.

7. An image forming apparatus according to claim 6, wherein the second controller carries out an initializing operation for a predetermined sheet processing unit in the sheet processing device after the power supply is started by the first controller.

8. An image forming apparatus according to claim 7, wherein the initializing operation for the sheet processing unit is to move a movable unit of the sheet processing unit to their home positions.

* * * * *

UNITED STATES PATENT AND TRADEMARK OFFICE

CERTIFICATE OF CORRECTION

PATENT NO. : 7,016,623 B2
APPLICATION NO. : 10/704635
DATED : March 21, 2006
INVENTOR(S) : Yoshinori Isobe It is certified that error appears in the above-identified patent and that said Letters Patent is hereby corrected as shown below:

COLUMN 4:
Line 5, "portion the" should read --portion of the--.
Line 7, "In the latent" should read --The latent--.
Line 65, "to the for" should read --to the--.

COLUMN 5:
Line 67, "for sheet" should read --for the sheet--.

COLUMN 6:
Line 8, "for image" should read --for the image--.
Line 21, "await for" should read --wait for--.

Signed and Sealed this

Twenty-ninth Day of August, 2006

JON W. DUDAS
*Director of the United States Patent and Trademark Office*